US009643176B2

(12) United States Patent
Liao et al.

(10) Patent No.: US 9,643,176 B2
(45) Date of Patent: May 9, 2017

(54) CHANNEL MIXER

(71) Applicant: DELTA ELECTRONICS, INC., Taoyuan (TW)

(72) Inventors: Shu-Hsien Liao, Taoyuan (TW); Ching-Yu Chang, Taoyuan (TW)

(73) Assignee: DELTA ELECTRONICS, INC. (TW)

( * ) Notice: Subject to any disclaimer, the term of this patent is extended or adjusted under 35 U.S.C. 154(b) by 0 days.

(21) Appl. No.: 14/865,780

(22) Filed: Sep. 25, 2015

(65) Prior Publication Data

US 2016/0375435 A1 Dec. 29, 2016

(30) Foreign Application Priority Data

Jun. 23, 2015 (TW) ..... 104120069 A

(51) Int. Cl.
*B01F 13/00* (2006.01)
*B01L 3/00* (2006.01)

(52) U.S. Cl.
CPC ..... *B01L 3/502* (2013.01); *B01F 13/0059* (2013.01); *B01L 2300/0816* (2013.01); *B01L 2300/0867* (2013.01); *B01L 2300/123* (2013.01); *B01L 2400/0481* (2013.01)

(58) Field of Classification Search
CPC ..... B81B 1/002; B81B 1/004; B01L 3/502; B01L 2300/0867; B01L 2300/123; B01L 2400/0481; B01F 13/0059
USPC ..... 366/176.1
See application file for complete search history.

(56) References Cited

U.S. PATENT DOCUMENTS 7,258,774 B2 * 8/2007 Chou ..... B01L 3/502738 422/504
7,335,166 B2 2/2008 Faupel et al.
2012/0022352 A1 1/2012 Fujiwara et al.

FOREIGN PATENT DOCUMENTS

| | | |
|---|---|---|
| CN | 1226057 | 11/2005 |
| JP | 2007-121275 | 5/2007 |
| TW | 201035551 | 10/2010 |
| TW | I359678 | 3/2012 |
| TW | 201407157 | 2/2014 |
| TW | 201447299 | 12/2014 |

* cited by examiner

*Primary Examiner* — Tony G Soohoo
*Assistant Examiner* — Anshu Bhatia
(74) *Attorney, Agent, or Firm* — Hauptman Ham, LLP

(57) ABSTRACT

A channel mixer includes a substrate, a channel assembly, and a pressing assembly. The channel assembly is located on the substrate and has at least one channel, a first opening for accommodating at least two testing materials, and a second opening. Two ends of the channel are respectively communicated with the first opening and the second opening. The pressing assembly covers the second opening and has an air chamber communicated with the second opening. When the pressing assembly recovers to an initial position after been pressed and released, the air chamber generates a negative pressure to draw the testing materials in the first opening therein, such that the testing materials are moved toward the second opening along the channel and mixed with each other.

16 Claims, 10 Drawing Sheets

CHANNEL MIXER

RELATED APPLICATIONS

This application claims priority to Taiwan Application Serial Number 104120069, filed Jun. 23, 2015, which is herein incorporated by reference.

BACKGROUND

Field of Invention

The present invention relates to a channel mixer.

Description of Related Art

In general, there are methods to test blood types through mixing blood and an antibody, including test-tube immediate centrifugal method, solid microplate method, and gel column agglutination method. In the test-tube immediate centrifugal method, blood and antibody are mixed in a test tube. If the blood is agglutinative, the blood is gathered to form blood agglutination that precipitate at the bottom of the test tube. However, in using the test-tube immediate centrifugal method to test blood types, it is required to pretreat a specimen with like centrifugal, clean, and/or dilution process, which not only prolonging the entire testing time, but also requiring a certain amount of blood and antibody to ensure the accuracy of testing result.

Moreover, in the solid microplate method, blood and an antibody are placed in microplates. Each of the microplates has many edges with a concave portion in the arc hole. The blood and the antibody are able to be mixed for a long time for shaking the microplates. If the blood is agglutinative, the blood is gathered into blood agglutination, and jammed in concave portion. If the blood is not agglutinative, blood cells are gathered in the central portion of the microplate. However, this method is only a semi-quantitative test for a rough estimation. In addition, the solid microplate method also suffers the disadvantages of long testing time and the necessary pretreatment of the specimen.

As refer to the gel column agglutination method, a column is filled with gel as a gel column, and the blood and the antibody are placed on the top of the gel. The blood and the antibody are mixed through a centrifugal method. If the blood is agglutinative, the blood is gathered into blood agglutination and jammed in the top or central portion of the gel. If not agglutinative, the blood is centrifuged to the bottom of the gel. However, it is expensive for a detection card with the gel columns used in the gel column agglutination method, and a centrifuge is required in the method. In addition, the gel column agglutination method also has the deficiencies of long testing time and the necessary pretreatment of the specimen.

SUMMARY

An aspect of the present invention is to provide a channel mixer.

According to an embodiment of the present invention, a channel mixer includes a substrate, a channel assembly, and a pressing assembly. The channel assembly is located on the substrate and has at least one channel, a first opening, and a second opening. Two ends of the channel are respectively communicated with the first opening and the second opening. The first opening is used to accommodate at least two testing materials. The pressing assembly covers the second opening and has an air chamber communicated with the second opening. When the pressing assembly recovers to an initial position after being pressed and released, the air chamber generates a negative pressure to draw the two testing materials in the first opening therein, such that the two testing materials are moved toward the second opening along the channel and mixed with each other.

In the aforementioned embodiments of the present invention, the two ends of the channel are respectively communicated with the first opening and the second opening, and the pressing assembly has the air chamber communicated with the second opening. As a result of such a design, when the two testing materials are in the first opening and the pressing assembly is pressed, the air chamber is pre-compressed to generate a positive pressure in the channel, thereby pressing the two testing materials to temporarily protrude a little from the first opening. After the external force pressing the pressing assembly is removed (released), the pressing assembly recovers to the initial position due to an elastic force. At this time, a negative pressure generated by the air chamber draws the two testing materials in the first opening to move in through a direction toward the second opening along the channel, such that the two testing materials are mixed with each other. The cost of the channel mixer is relative low, and the channel mixer can be operated without electrical power. Moreover, the two testing materials can be mixed only by continuously pressing and releasing the pressing assembly, so that the channel mixer is flexibly used. When the two testing materials are blood and antibody, whether the agglutination phenomenon of the blood occurring in the channel or not can both be observed to distinguish blood types, and typical testing steps can be significantly simplified.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
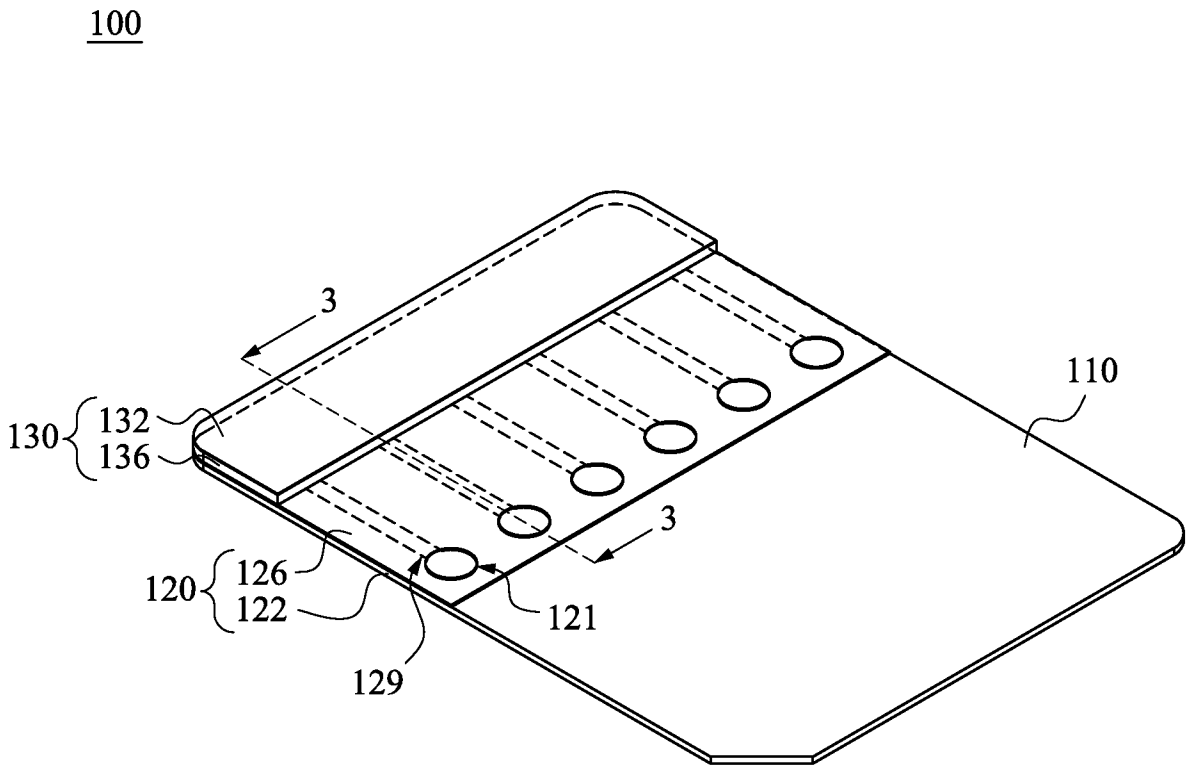
FIG. 1 is a perspective view of a channel mixer according to one embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
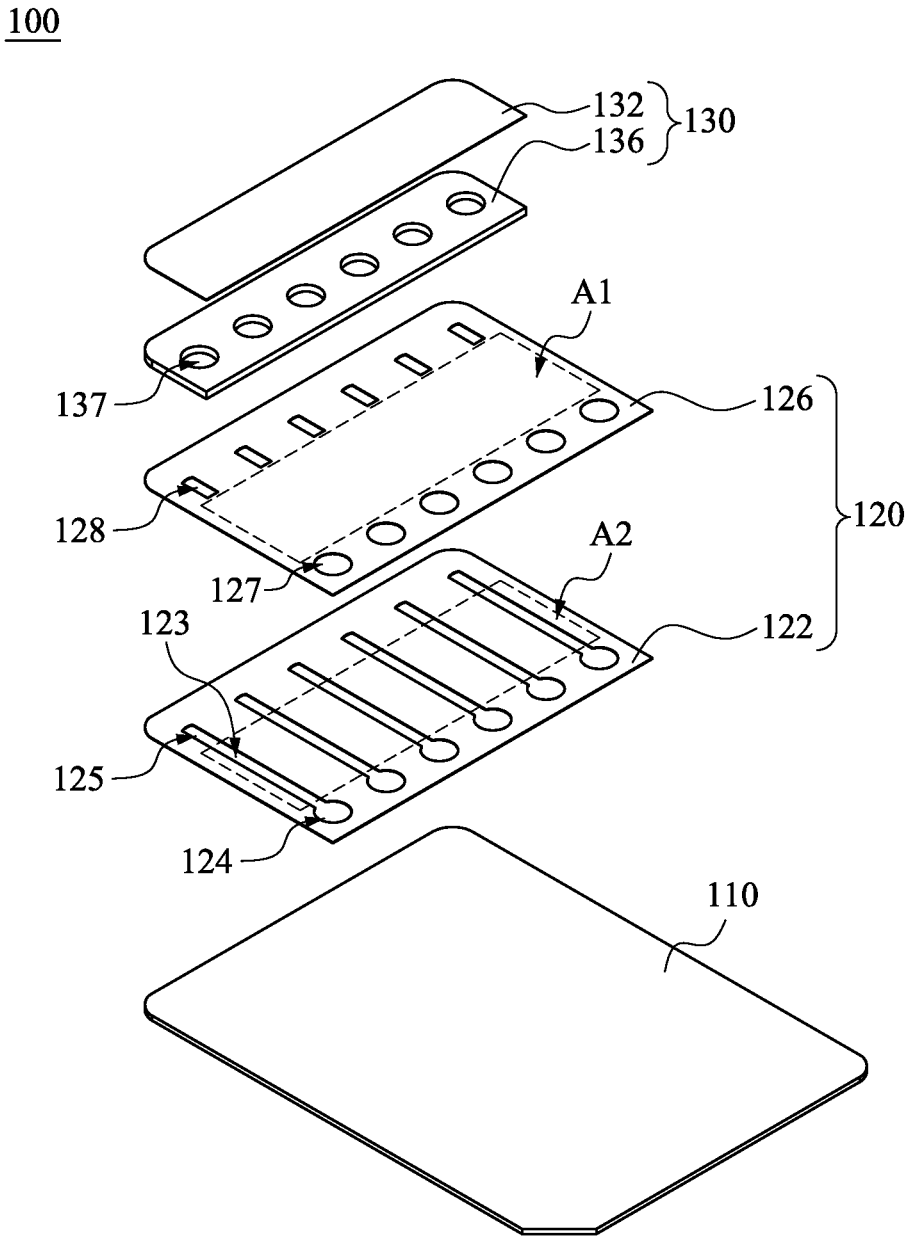
FIG. 2 is an exploded view of the channel mixer shown in FIG. 1.

FIG. 1 is a perspective view of a channel mixer according to one embodiment of the present invention. FIG. 2 is an exploded view of the channel mixer shown in FIG. 1. As shown in FIG. 1 and FIG. 2, the channel mixer 100 includes a substrate 110, a channel assembly 120, and a pressing assembly 130. The channel assembly 120 is located on the substrate 110 and has at least one channel 129 (see the dotted line region of FIG. 1), a first opening 121 (see FIG. 1), and a second opening 128 (see FIG. 2). Two ends of the channel 129 are respectively communicated with the first opening 121 and the second opening 128. The first opening 121 can be used to accommodate at least two to-be mixed testing materials 210 (see FIG. 4A). Moreover, the pressing assembly 130 covers the second opening 128. In the following description, the forming or definition methods of the channel 129 and the first opening 121 will be described.

The channel assembly 120 includes a channel layer 122 and a covering layer 126. The channel layer 122 has at least one hollow groove 123. The covering layer 126 is located on the channel layer 122 and covers the hollow groove 123, such that the hollow groove 123 of the channel layer 122 is between the covering layer 126 and the substrate 110. As a result, the upper portion of the hollow groove 123 is closed by the covering layer 126, and the lower portion of the hollow groove 123 is closed by the substrate 110. The channel 129 shown in FIG. 1 is defined by both of the covering layer 126 and the channel layer 122. In this embodiment, the height of the channel 129 (or the depth of the chiseled hollow groove 123) is equal to the thickness of the channel layer 122, such as 0.1 mm, but the present invention is not limited in this regard. For example, designers may design the thickness, width, and length of the hollow groove 123 according to the types of the to-be mixed testing materials. It is to be noted that the hollow groove 123 is through the channel layer 122. In another embodiment, a ditch-like structure may be formed a portion of the channel layer 122 by chiseling.

Moreover, the channel layer 122 has at least one first hollow hole 124 that is communicated with an end of the hollow groove 123, and the covering layer 126 has at least one second hollow hole 127. The position of the second hollow hole 127 corresponds to that of the first hollow hole 124, such that the first hollow hole 124 may be aligned with and communicated with the second hollow hole 127 after the channel assembly 120 is assembled. Hence, the first opening 121 shown in FIG. 1 is formed or defined by both of the first hollow hole 124 and second hollow hole 127. In this embodiment, the channel layer 122 has plural hollow grooves 123 and plural first hollow holes 124, and the same side ends 125 of the hollow grooves 123 facing away from the first hollow holes 124 are in a parallel arrangement, but the present invention is not limited in this regard. In the detailed description, the plural hollow grooves 123 in this embodiment substantially extend in a direction away from the corresponding first hollow holes 124, and extending same side ends 125 of the hollow grooves 123 are in a parallel arrangement.

The covering layer 126 is substantially a flat thin layer and has the second opening 128. The position of the second opening 128 corresponds to that of the end 125 of the hollow groove 123 facing away from the first hollow hole 124, such that the second opening 128 is communicated with the hollow groove 123. In this embodiment, the covering layer 126 has plural second openings 128, and the second openings 128 are in a parallel arrangement, but the present invention is not limited in this regard. The covering layer 126 may be made of a material including glass, polyethylene terephthalate (PET), acrylic, or other light-permeable materials. When the testing materials enter the channel 129 from the first opening 121, users can directly observe the state and the variation of the testing materials that are in the channel 129 through the light-permeable covering layer 126. In another embodiment, only a portion of the covering layer 126 may have a light-permeable region A1 (as shown in the dotted-line rectangular of FIG. 2). For example, the light-permeable region A1 is between the second opening 128 and the second hollow hole 127. When the testing materials enter the channel 129 from the first opening 121, users can remain observing the state of the testing materials in the channel 129 through the light-permeable region A1 of the covering layer 126.

The channel layer 122 may have an observing region A2 (as shown in the dotted-line rectangular of FIG. 2), and at lest a portion of the hollow groove 123 is located in the observing region A2. In this embodiment, the end 125 of the hollow groove 123 covered by the pressing assembly 130, and the first hollow hole 124 are not in the observing region A2, other portion of the channel layer 122 is in the observing region A2. Moreover, when the covering layer 126 covers the channel layer 122, at least a portion of the area of the light-permeable region A1 of the covering layer 126 overlaps the area of the observing region A2 of the channel layer 122 in an assembly direction. In this embodiment, the observing region A2 completely overlaps a region between the second opening 128 and the second hollow hole 127 of the covering layer 126.

The substrate 110 is substantially a flat thin layer. The substrate 110 may be made of a material including polyethylene terephthalate (PET), polycarbonate (PC), polystyrene (PS), glass, or aluminum, but the present invention is not limited to the aforementioned materials. It is necessary only that macromolecule, metal, or nonmetal materials having light-permeable and optical reflective properties may be utilized to manufacture the substrate 110. For example, if the substrate 110 is light-permeable, users can observe the state of the testing materials in the channel 129 from the bottom surface of the substrate 110 (i.e., a surface facing away from the channel layer 122). Alternatively, if the substrate 110 is optically reflective (e.g., a white and opaque reflective material), users can clearly observe the state of the testing materials in the channel 129 from the covering layer 126.

Figure 3:
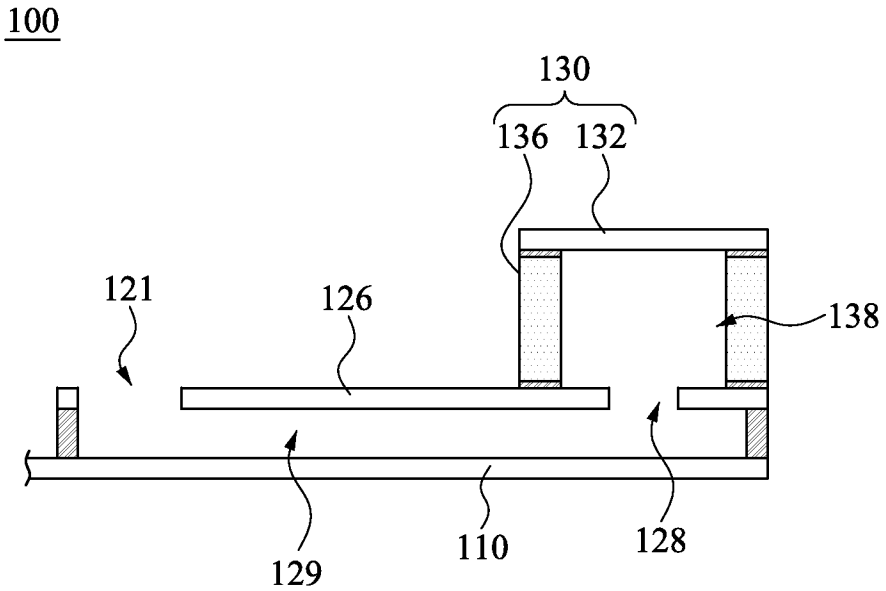
FIG. 3 is a cross-sectional view of the channel mixer taken along line 3-3 shown in FIG. 1.

FIG. 3 is a cross-sectional view of the channel mixer taken along line 3-3 shown in FIG. 1. As shown in FIG. 2 and FIG. 3, the pressing assembly 130 has an air chamber 138 communicated with the second opening 128. The pressing assembly 130 includes an air chamber cover 132 and a flexible layer 136. The flexible layer 136 is between the air chamber cover 132 and the channel assembly 120. The flexible layer 136 has at least one hollow region 137. The hollow region 137 is communicated with the corresponding second opening 128. The hollow region 137 is between the air chamber cover 132 and the covering layer 126, such that the air chamber 138 is defined by both of the air chamber cover 132 and the covering layer 126. That is to say, the upper portion of the hollow region 137 is closed by the air chamber cover 132. In this embodiment, the flexible layer 136 has plural hollow regions 137, and the hollow regions 137 are in a parallel arrangement. The flexible layer 136 may be made of a material including foam, rubber, or flexible materials, but the present invention is not limited to the aforesaid materials, and all compressible materials may be used to manufacture the flexible layer 136. When the air chamber cover 132 is pressed, the flexible layer 136 under the air chamber cover 132 is deformed by compression. When an external force pressing the air chamber cover 132 is removed or released, the flexible layer 136 recovers to an initial state without compression due to its flexibility.

The air chamber cover 132 may be a soft material or a rigid material as deemed necessary by designers. For example, when the air chamber cover 132 is a soft material, users may press an area of the air chamber cover 132 above a single hollow region 137, thereby independently compressing the volume of a single air chamber 138. Alternatively, when the air chamber cover 132 is a rigid material and has plural hollow regions 137, users must press an entire air chamber cover 132 to simultaneously compress the volumes of different air chambers 138.

In order to simplify the following description, the channel 129 in FIGS. 4B, 5B, 6B, 7B, and 8B are shown with solid lines. In fact, the channel 129 is under the covering layer 126. Moreover, testing materials 210 in drawings are referred to as two materials that are not yet mixed, and testing materials 210*a* are referred to as the two materials that have been mixed.

Figure 4B:
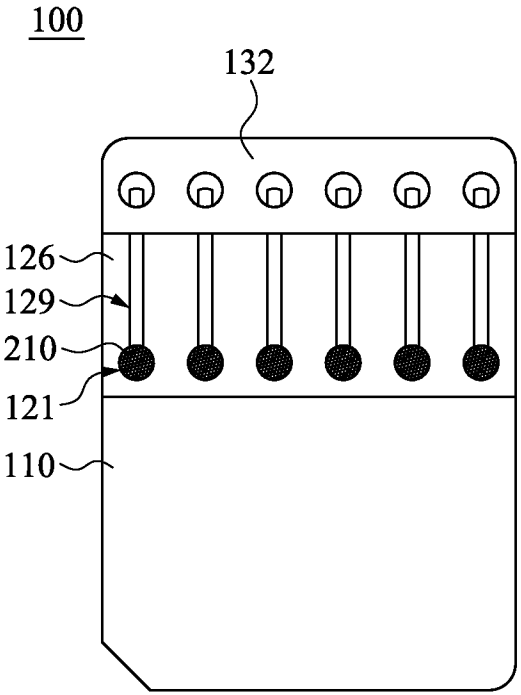
FIG. 4B is a top view of the testing materials after being dropped in the first opening shown in FIG. 1.
Figure 4A:
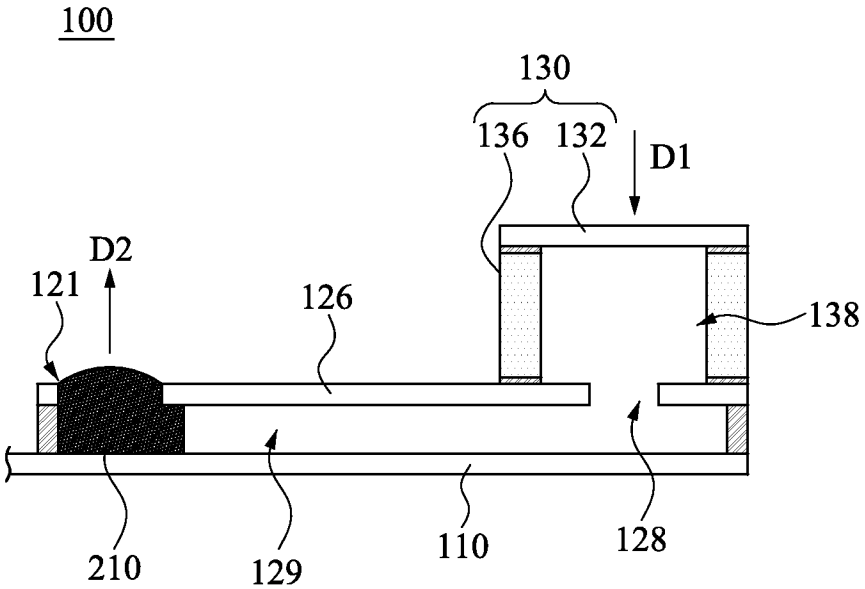
FIG. 4A is a cross-sectional view of testing materials after being dropped in the first opening shown in FIG. 3.

FIG. 4A is a cross-sectional view of the testing materials after being dropped in the first opening shown in FIG. 3. FIG. 4B is a top view of the testing materials after being dropped in the first opening shown in FIG. 1. As shown in FIG. 4A and FIG. 4B, when the two testing materials 210 are dropped in the first opening 121, the testing materials 210 may close the first opening 121, such that a closed space is formed by the channel 129 and the air chamber 138 communicated with the channel 129. Since a pressure exists in the closed space, the testing materials 210 do not move toward the second opening 127 along the channel 129 at this moment. In this embodiment, the two testing materials 210 may respectively be a to-be tested material and a discrimination material. The to-be tested material may include a biological specimen, food, an environmental substance, a microorganism, or combinations thereof, and the discrimination material may include an antibody, an antigen, an indicator, a dye, a biomarker, or combinations thereof. For example, the two testing materials 210 may respectively be blood and antibody, or may respectively be a dye and a phosphate solution, but the present invention is not limited to the aforesaid materials.

Figure 5B:
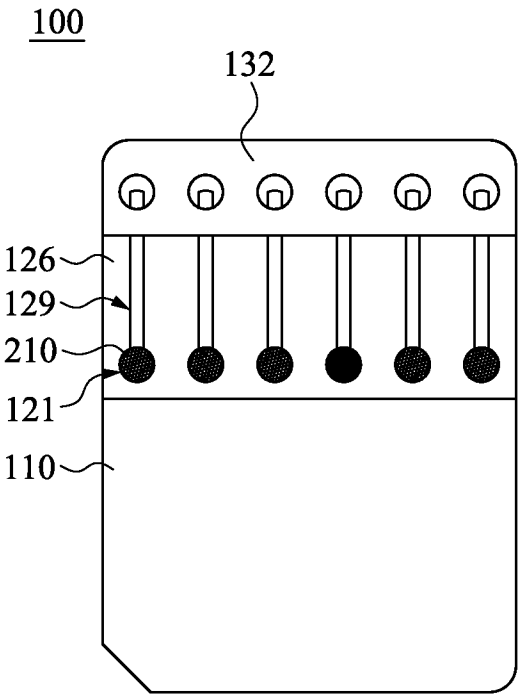
FIG. 5B is a top view of the pressing assembly shown in FIG. 4B after being pressed.
Figure 5A:
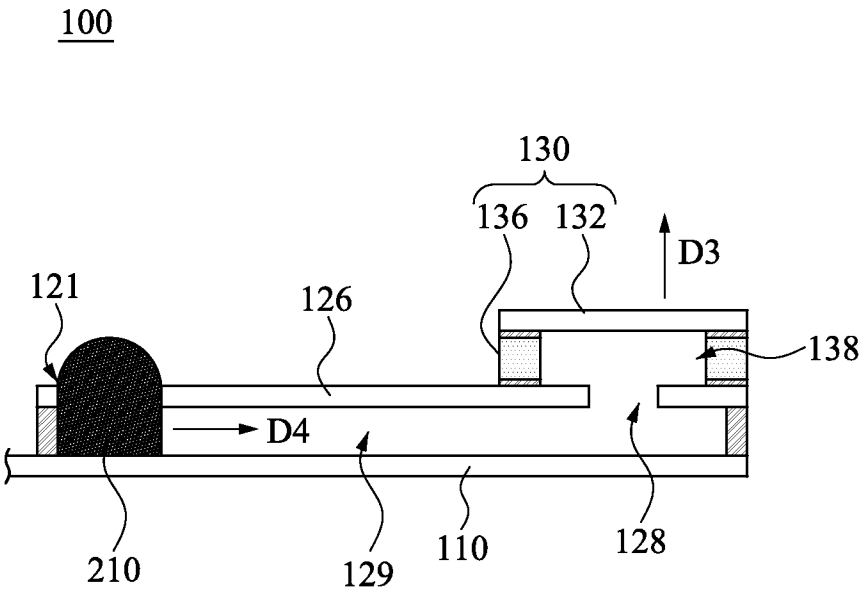
FIG. 5A is a cross-sectional view of a pressing assembly shown in FIG. 4A after being pressed.

FIG. 5A is a cross-sectional view of the pressing assembly shown in FIG. 4A after being pressed. As shown in FIG. 4A and FIG. 5A, after the testing materials 210 are in the first opening 121, the pressing assembly 130 may be pressed in a direction D1 shown in FIG. 4A, such that the air chamber 138 is compressed to generate a positive pressure in the channel 129. As a result, the testing materials 210 are pressed to temporarily protrude a little in a direction D2 from the first opening 121 but not to overflow. In this step, user outside the channel mixer 100 may observe the distribution of the testing materials 210 shown in FIG. 5B.

Figure 6B:
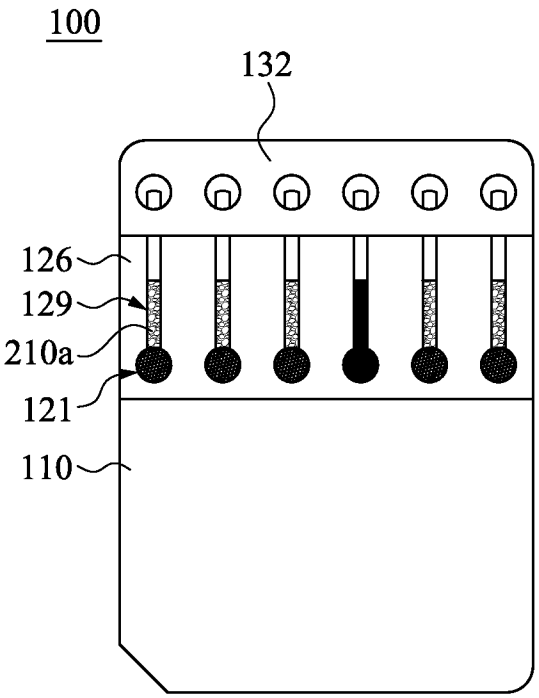
FIG. 6B is a top view of the pressing assembly shown in FIG. 5B after recovering to the initial position.
Figure 6A:
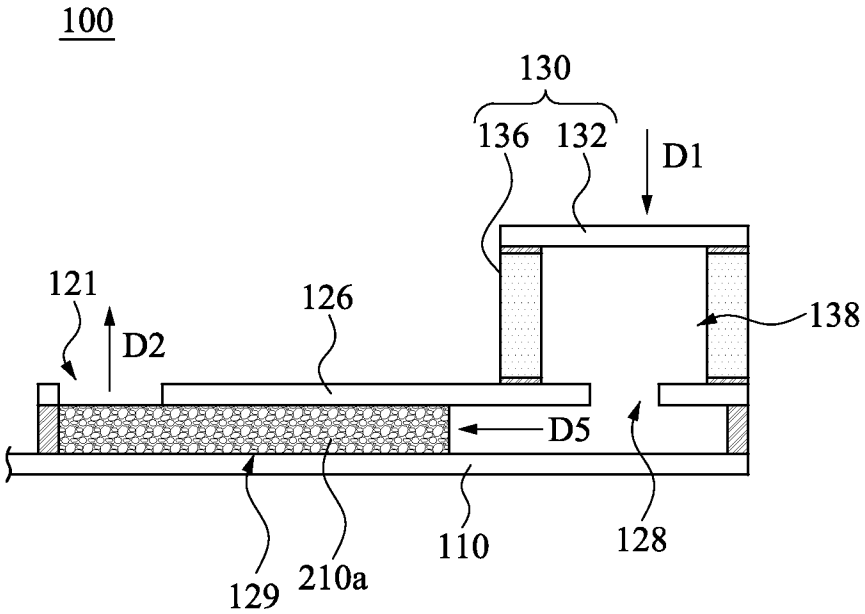
FIG. 6A is a cross-sectional view of the pressing assembly shown in FIG. 5A after recovering to an initial position.

FIG. 6A is a cross-sectional view of the pressing assembly shown in FIG. 5A after recovering to an initial position. As shown in FIG. 5A and FIG. 6A, after the external force pressing the pressing assembly 130 is removed or released, the pressing assembly 130 recovers to the initial position in a direction D3 shown in FIG. 5A through the flexibility of the flexible layer 136. In an ideal situation, the pressing assembly 130 recovers to the position shown in FIG. 4A, and the position is referred to as a predetermined position. At this moment, the air chamber 138 correspondingly generates a negative pressure to draw the testing materials 210 in the first opening 121 therein, such that the testing materials 210 are moved toward the second opening 128 in a direction D4 along the channel 129. As a result, the testing materials 210 may be mixed with each other in the channel 129, and the mixed testing materials 210*a* are formed. In this step, user outside the channel mixer 100 may observe the distribution of the testing materials 210*a* shown in FIG. 6B.

The cost of the channel mixer 100 of the present invention is low, and the channel mixer 100 can be operated without electrical or machine power. Moreover, the two testing materials 210 can be mixed only by continuously pressing and releasing the pressing assembly 130, so that the channel mixer 100 is flexibly and conveniently used. When the two testing materials 210 are blood and antibody, whether the agglutination phenomenon of the blood occurring in the channel 129 or not can be observed to distinguish blood types, and typical testing steps can be significantly simplified.

Figure 7B:
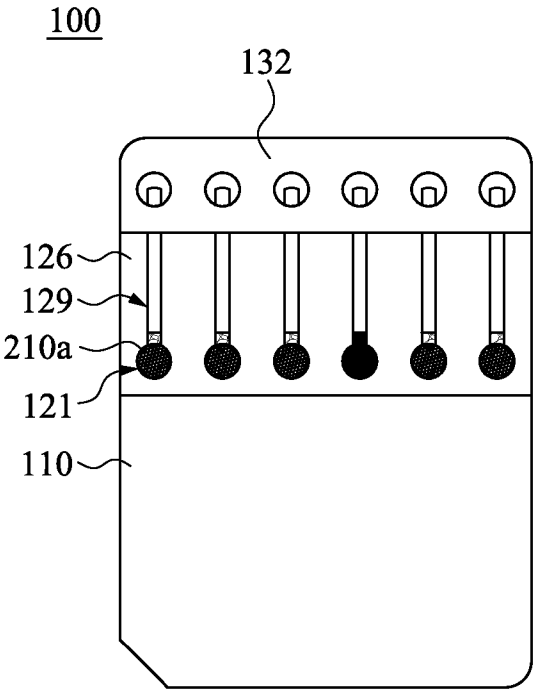
FIG. 7B is a top view of the pressing assembly shown in FIG. 6B after being pressed again.
Figure 7A:
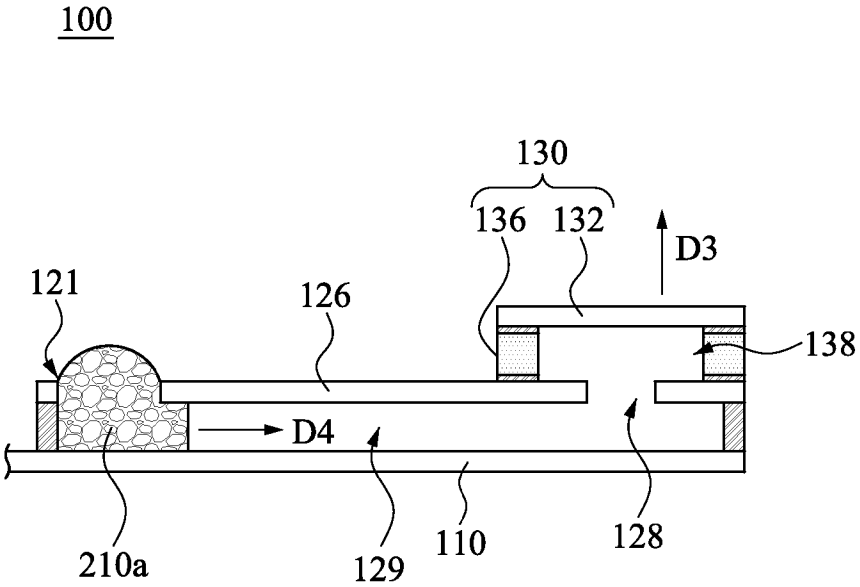
FIG. 7A is a cross-sectional view of the pressing assembly shown in FIG. 6A after being pressed again.

FIG. 7A is a cross-sectional view of the pressing assembly shown in FIG. 6A after being pressed again. As shown in FIG. 6A and FIG. 7A, if users consider that the mixed testing materials 210*a* are not mixed adequately after the pressing assembly 130 recovers to the initial position, user can press the pressing assembly 130 in the aforesaid direction D1 again. As a result, the air chamber 138 is compressed again to generate a positive pressure in the channel 129, and thus the testing materials 210*a* are pressed to move in a direction D5 and temporarily protrude a little in the direction D2 from the first opening 121 but not to overflow. In this step, user outside the channel mixer 100 may observe the distribution of the testing materials 210*a* shown in FIG. 7B.

Figure 8B:
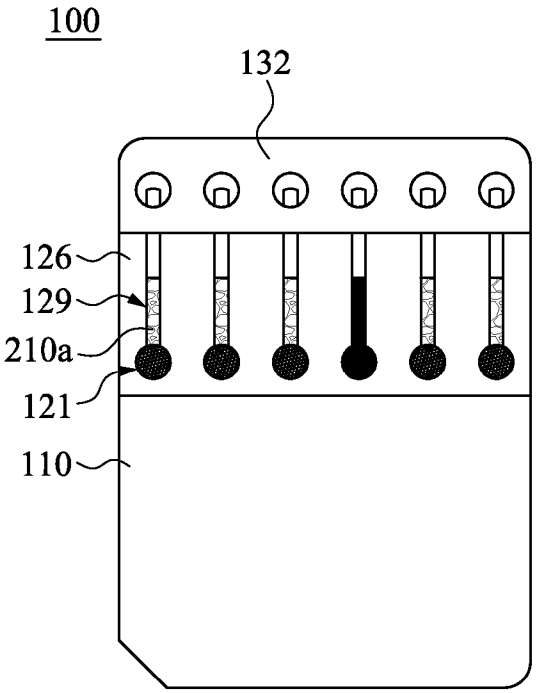
FIG. 8B is a top view of the pressing assembly shown in FIG. 7B after recovering to the initial position.
Figure 8A:
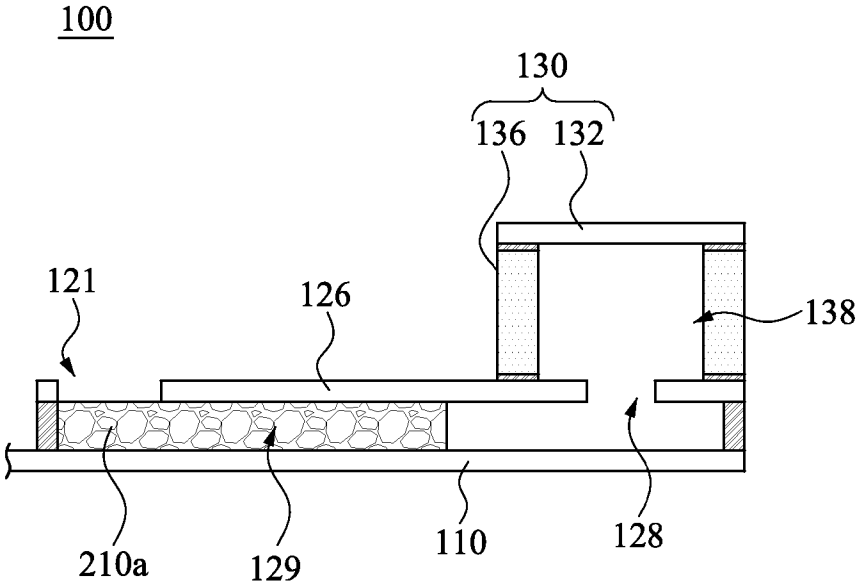
FIG. 8A is a cross-sectional view of the pressing assembly shown in FIG. 7A after recovering to the initial position.

FIG. 8A is a cross-sectional view of the pressing assembly shown in FIG. 7A after recovering to the initial position. As shown in FIG. 7A and FIG. 7B, after the external force pressing the pressing assembly 130 is removed or released, the pressing assembly 130 recovers to the initial position in the direction D3 through the flexibility of the flexible layer 136. In an ideal situation, the pressing assembly 130 recovers to the predetermined position shown in FIG. 6A or FIG. 4A. At this moment, the air chamber 138 generates a negative pressure to draw the testing materials 210*a* in the first opening 121 therein again, such that the testing materials 210*a* are moved toward the second opening 128 in the direction D4 along the channel 129. As a result, the mixed testing materials 210*a* may be mixed again in the channel 129. In this step, user outside the channel mixer 100 may observe the distribution of the mixed testing materials 210*a* shown in FIG. 8B. User may determine the number of pressing times and continuously pressing or releasing time according to the state of the mixed testing materials 210*a*, such as 5 seconds, 10 seconds, or 15 seconds, but the present invention is not limited in this regard.

In this embodiment, only the mixed testing materials 210*a* in the third channel 129 from the right do not occur agglutination phenomenon, and other mixed testing materials 210*a* in other channels 129 occur agglutination phenomenon. Accordingly, the channel mixer 100 of the present invention can be utilized to distinguish blood types by the agglutination phenomenon of the mixed testing materials 210*a*.

It is to be noted that the materials and connection relationships of the elements described above will not be repeated in the following description, and only aspects related to other types of the channel mixer will be described.

Figure 9:
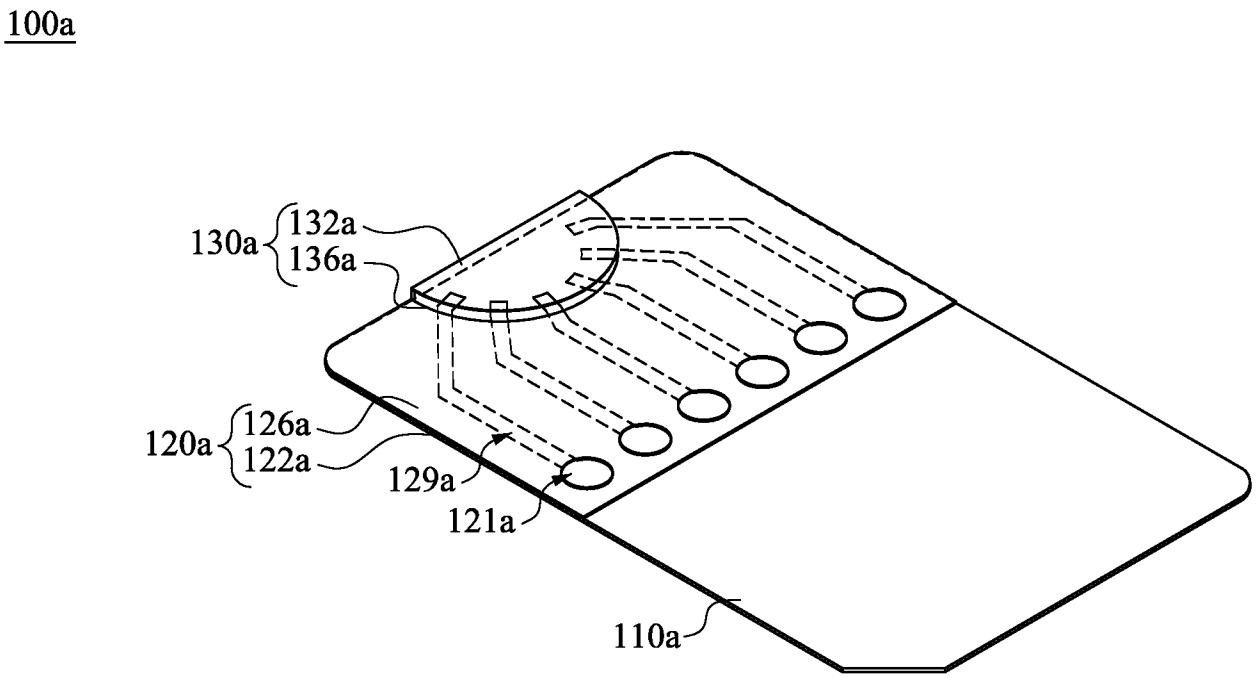
FIG. 9 is a perspective view of a channel mixer according to another embodiment of the present invention.
Figure 10:
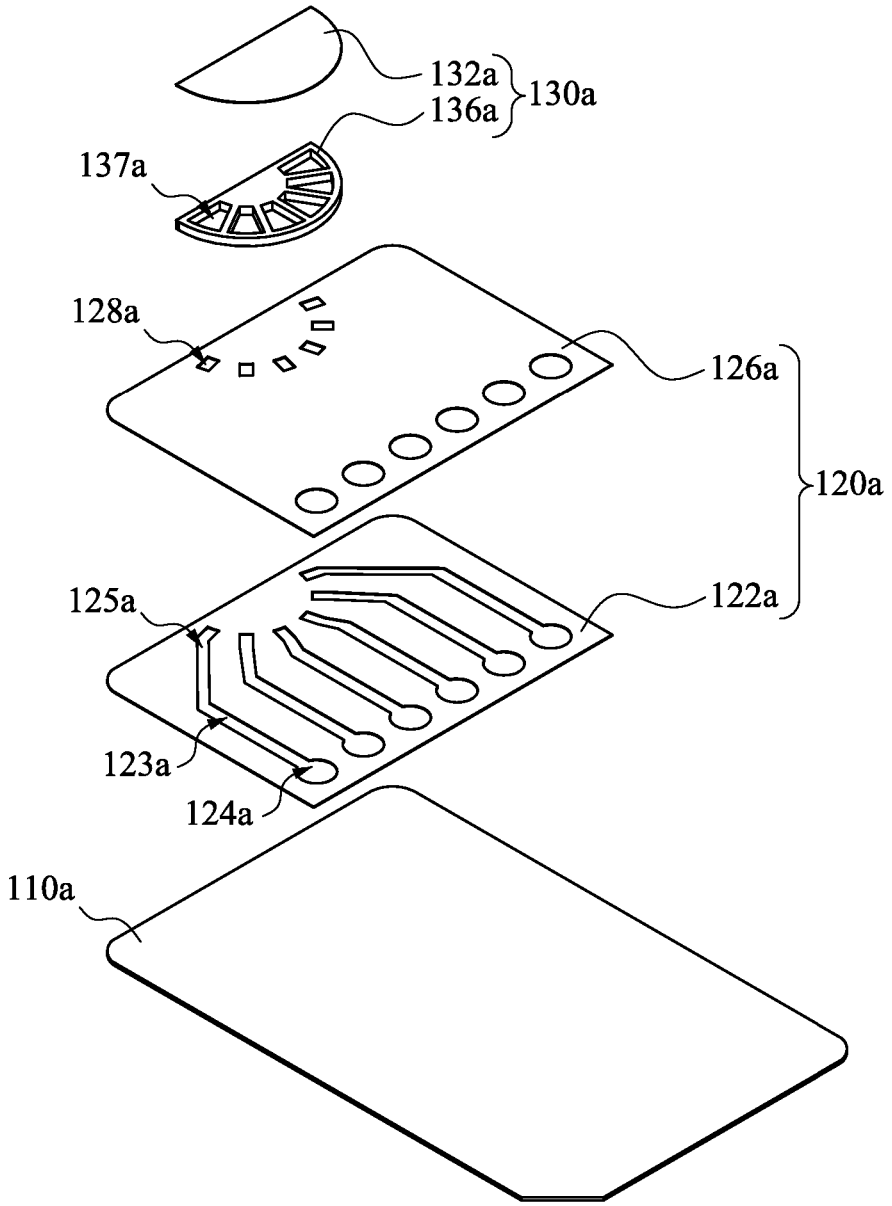
FIG. 10 is an exploded view of the channel mixer shown in FIG. 9.

FIG. 9 is a perspective view of a channel mixer according to another embodiment of the present invention. FIG. 10 is an exploded view of the channel mixer shown in FIG. 9. As shown in FIG. 9 and FIG. 10, the channel mixer 100*a* includes a substrate 110*a*, a channel assembly 120*a*, and a pressing assembly 130*a*. The channel assembly 120*a* includes a channel layer 122*a* and a covering layer 126*a*. The pressing assembly 130*a* includes an air chamber cover 132*a* and a flexible layer 136*a*. The difference between this embodiment and the embodiment shown in FIGS. 1 and 2 is that the shape of the pressing assembly 130*a* is semicircular. Moreover, the second openings 128*a* of the covering layer 126*a* are in a radiation arrangement, the same side ends 125*a* of the hollow grooves 123*a* facing away from the first hollow holes 124*a* are in a radiation arrangement, and the hollow regions 137*a* of the flexible layer 136*a* are in a radiation arrangement.

Regarding to the above description, in this embodiment, when two testing materials are in each of first openings 121*a*, the air chamber cover 132*a* can be pressed one time and thus recover to an initial position. Hence, the testing materials in the first openings 121*a* may be simultaneously drawn to flow toward corresponding second openings 128*a* along corresponding channels 129*a*. The states of the testing materials correspond to different positions of the pressing assembly 130*a* may be referred in FIGS. 4A to 8B, and not described again.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A channel mixer, comprising:

a substrate;

a channel assembly located on the substrate and having at least one channel, a first opening, and a second opening, wherein at least a portion of the substrate is exposed through the first opening, and two ends of the channel are respectively communicated with the first opening and the second opening, and the first opening is configured for accommodating at least two testing materials; and a pressing assembly covering the second opening and having an air chamber communicated with the second opening, wherein the second opening is between the channel and the air chamber, such that at least a portion of the pressing assembly faces the substrate through the second opening, wherein, when the pressing assembly recovers to an initial position after being pressed and released, the air chamber generates a negative pressure to draw the testing materials in the first opening therein, such that the testing materials are moved toward the second opening along the channel and mixed with each other.

2. The channel mixer of claim 1, wherein the channel assembly comprises:

a channel layer having at least one hollow groove; and a covering layer located on the channel layer and covering the hollow groove, such that the channel is defined by both of the covering layer and the channel layer.

3. The channel mixer of claim 2, wherein a first hollow hole is formed in the channel layer and communicated with an end of the hollow groove; and a second hollow hole is formed in the covering layer, and a position of the second hollow hole corresponds to that of the first hollow hole, such that the first opening is defined by both of the first hollow hole and the second hollow hole.

4. The channel mixer of claim 3, wherein a position of the second opening corresponds to that of an end of the hollow groove of the channel layer facing away from the first hollow hole.

5. The channel mixer of claim 3, wherein the covering layer further comprises a light-permeable region between the second opening and the second hollow hole.

6. The channel mixer of claim 5, wherein the channel layer further comprises an observing region, wherein at least a portion of the hollow groove is located in the observing region, and at least a portion of an area of the light-permeable region of the covering layer overlaps an area of the observing region.

7. The channel mixer of claim 3, wherein a plurality of hollow grooves and a plurality of first hollow holes corresponding to the hollow grooves are formed in the channel layer, and the hollow grooves extend in a direction away from the corresponding first hollow holes.

8. The channel mixer of claim 7, wherein a plurality of second hollow holes and a plurality of corresponding second openings are formed in the covering layer; positions of the second hollow holes respectively correspond to that of the first hollow holes, such that a plurality of first openings are defined by both of the first hollow holes and the second hollow holes; and positions of the second openings respectively correspond to that of the hollow grooves.

9. The channel mixer of claim 2, wherein the covering layer is made of a material comprising glass, polyethylene terephthalate, or acrylic.

10. The channel mixer of claim 1, wherein the pressing assembly comprises:

an air chamber cover; and a flexible layer between the air chamber cover and the channel assembly, and having at least one hollow region, wherein the hollow region is communicated with the second opening and between the air chamber cover and the covering layer, such that the air chamber is defined by both of the air chamber cover and the covering layer.

11. The channel mixer of claim 10, wherein the flexible layer is made of a material comprising foam, rubber, or flexible materials.

12. The channel mixer of claim 1, wherein the substrate is made of a material comprising polyethylene terephthalate, polycarbonate, polystyrene, glass, or aluminum.

13. The channel mixer of claim 7, wherein the pressing assembly comprises:

an air chamber cover; and a flexible layer between the air chamber cover and the channel assembly and having a plurality of hollow regions, wherein the hollow regions are communicated with the corresponding second openings and between the air chamber cover and the covering layer, such that a plurality of air chambers are defined by both of the air chamber cover and the covering layer.

14. The channel mixer of claim 1, wherein the testing materials comprises a to-be tested material and a discrimination material.

15. The channel mixer of claim 14, wherein the to-be tested material comprises a biological specimen, food, an environmental substance, a microorganism, or combinations thereof.

16. The channel mixer of claim 14, wherein the discrimination material comprises an antibody, an antigen, an indicator, a dye, a biomarker, or combinations thereof.

* * * * *